US005792536A

United States Patent [19]

Whipp

[11] Patent Number: 5,792,536

[45] Date of Patent: Aug. 11, 1998

[54] MULTIPLE-LAYER LABEL

[75] Inventor: Andrew Whipp, Mississauga, Canada

[73] Assignee: CCL Label, Inc., Sioux Falls, S. Dak.

[21] Appl. No.: 640,083

[22] Filed: Apr. 30, 1996

[51] Int. Cl.[6] ..... B42D 15/00

[52] U.S. Cl. ..... 428/40.1; 40/299; 283/94; 283/98; 283/103; 428/41.3; 428/41.5; 428/41.7; 428/41.8; 428/41.9; 428/42.2; 428/42.3; 428/43; 428/194

[58] Field of Search ..... 428/40.1, 41.3, 428/41.5, 41.7, 41.8, 41.9, 42.2, 42.3, 43, 194; 40/299, 324; 283/81, 94, 98, 103

[56] References Cited

U.S. PATENT DOCUMENTS

| | | | |
|---|---|---|---|
| 4,332,635 | 6/1982 | Holbrook | 156/256 |
| 4,526,405 | 7/1985 | Hattemer . | |
| 4,767,119 | 8/1988 | Fadner et al. . | |
| 4,830,406 | 5/1989 | Instance | 428/40.1 |
| 4,846,504 | 7/1989 | MacGregor et al. . | |
| 4,884,826 | 12/1989 | Slagsvol | 428/194 |
| 4,988,550 | 1/1991 | Keyser | 428/194 |
| 5,071,167 | 12/1991 | O'Brien . | |
| 5,076,613 | 12/1991 | Kovacs . | |
| 5,106,124 | 4/1992 | Volkman et al. . | |
| 5,259,031 | 11/1993 | Shibahara . | |
| 5,290,616 | 3/1994 | Cowan et al. . | |
| 5,653,473 | 8/1997 | Laszutko | 283/103 |

*Primary Examiner*—Nasser Ahmad
*Attorney, Agent, or Firm*—Warner Norcross & Judd LLP

[57] ABSTRACT

A Multiple-layer label having an essentially non-shrinking first layer, an essentially extensible second layer, and means for releasably attaching the second layer to the first layer. The multiple-layer label is secured to a shrinkable base material prior to shrinking the base material to form a container, without detaching the multiple layers of the label during the shrinking process.

13 Claims, 2 Drawing Sheets

MULTIPLE-LAYER LABEL

BACKGROUND OF THE INVENTION

The present invention relates to labels, and more particularly to labels having multiple layers.

As marketing promotions, marketers often distribute award coupons or game pieces by attaching multiple-layer labels to product packaging or containers. In a typical application, the first layer of the label attaches to the container, and the second layer of the label releasably attaches to the first layer. The bottom of the second layer displays prize or award information, which is hidden from view until the second layer is detached from the first layer. Typically, the first and second layers are paper, since paper is a relatively inexpensive material.

The process for making polystyrene cups generally consists of the following steps. First, nip rollers feed a polystyrene foam web to a die cutter, which cuts the web into sections having various lengths depending on cup sizes. Second, each section is wrapped around a tapered mandrel heated from about 250° F. to about 300° F. The section dwells around the mandrel for approximately ten seconds, and shrinks around the mandrel to form a frustoconically-shaped section. Third, a bottom portion of polystyrene is attached to the frustoconically-shaped section to form a completed cup. For the next few days, the cup post-cures by shrinking a residual amount.

A label may often be more quickly and less expensively applied to a container by applying it early in the process of producing the container. However, problems occur when attempting to form labeled cups from a polystyrene foamed web having attached multiple-layer paper labels. First, nip rollers in the process tend to tear the multiple-layer labels. Further, perforations in a multiple-layered label tend to separate or detach when the polystyrene shrinks either during the heating mandrel step or the post-cure period. Increasing the perforation strength by using a plastic material that can withstand the processing conditions of the cup manufacturing process, such as polyester, unacceptably increases the cost of the label. Other less expensive plastic materials such as polystyrene tend to melt or shrink at the processing conditions used to form the polystyrene cups.

SUMMARY OF THE INVENTION

The aforementioned problems are overcome in the present invention wherein a label contains multiple layers; the first layer comprising an essentially non-shrinking material, and the second layer comprising an essentially extensible material. The first layer is attached to an object, such as a cup, and is releasably secured to the second layer, so that the second layer can be removed from the first layer without removing the first layer from the object.

In one embodiment, the first layer is attached to the second layer by an adhesive located in select zones between the first and second layers; and the second layer contains perforations in areas corresponding to the select zones to facilitate separation of at least a portion of the second layer from the first layer.

The essentially non-shrinking first layer, when attached to a shrinkable material or web from which a container is made, prevents distortion of the label by the shrinkage of the web during formation of the container. The essentially extensible second layer provides strength and flexibility so that the label perforations do not break during processing and the label does not tear when moving through the nip rollers.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
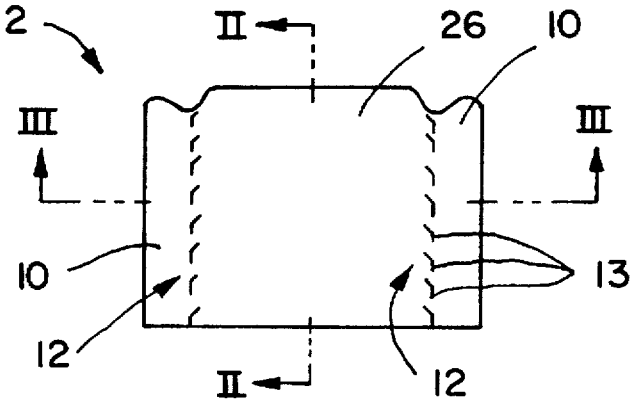
FIG. 1 is a plan view of the multiple-layer label of the present invention.
Figure 2:
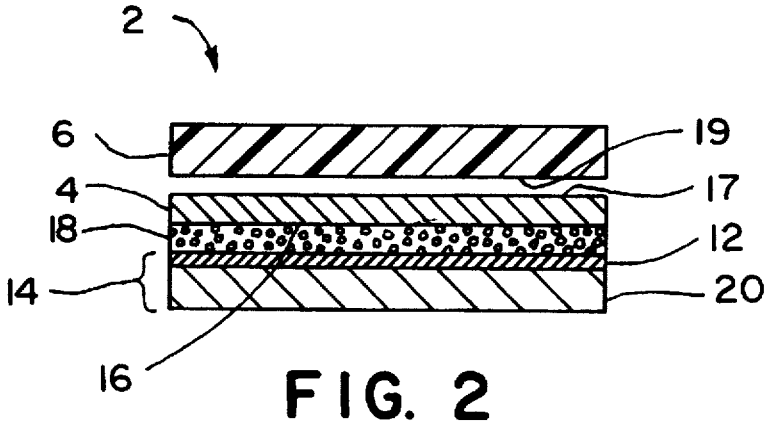
FIG. 2 is a sectional view taken along the line II—II of FIG. 1.
Figure 3:
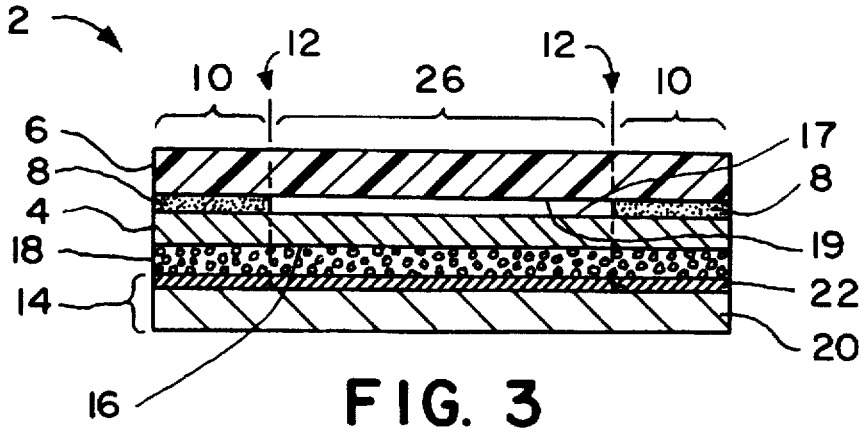
FIG. 3 is a sectional view taken along the line III—III of FIG. 1.

FIGS. 1, 2 and 3 show the multiple-layer label of the present invention. Multiple-layer label 2 contains the first layer 4, which is made of an essentially non-shrinking material that can withstand the subsequent processing conditions. "Essentially non-shrinking" means that processing conditions do not cause significant shrinkage or dimensional change. For polystyrene cup applications, preferably first layer 4 is paper. The paper has sufficient tensile strength to be handled in conventional paper coating and treating apparatus. Included among the types of paper which can be used are paper, clay-coated paper, glassine, polymer-coated paper, paperboard from straw, bark, wood, cotton, flax, corn stalks, sugar cane, bagasse, bamboo, hemp, and similar cellulose materials prepared by such processes as the soda, sulfite, or sulfate (KRAFT) processes, the neutral sulfide cooking process, alkali-chlorine processes, nitric acid processes, and semi-chemical processes. Paper having weights in the range from about 20 to about 150 pounds per ream are preferred, and papers having weights in the range from about 30 to about 100 pounds a ream are the most preferred. The term "ream" as used herein equals 3,000 square feet.

Multiple-layered label 2 also contains second layer 6, which is made of an essentially extensible material. "Essentially extensible" means flexibility and strength such that processing conditions normally encountered in label handling equipment can stretch or deform a material without tearing or breaking it. In this sense, many plastics are essentially extensible materials, such as polymers, copolymers, and coextrusions of polyethylenes, polypropylenes, polystyrenes, and polyesters. The selection of the material of which second layer 6 is constructed will depend upon the processing conditions to which label 2 is subjected when processing the base material to which label 2 is attached, as discussed below. For the processing of polystyrene cups, preferably second layer 6 is a polypropylene, more preferably a polypropylene having a thickness of from about 1 mil to about 6 mils. Polypropylene is a relatively inexpensive extensible material for label applications.

Second layer 6 is releasably secured to first layer 4. This can be accomplished, for example, by applying a pattern of adhesive 8 between first layer 4 and second layer 6 only in select zones, preferably in side regions 10, followed by laminating first layer 4 to second layer 6, using conventional production techniques used for pressure-sensitive labels. Pattern adhesive 8 can be a laminating adhesive, which is applied in an appropriate thickness. Laminating adhesives and their appropriate thicknesses are known in the art. Thus, first layer 4 and second layer 6 are secured to each other only in the side regions 10. Other embodiments can have an adhesive located in other select regions or zones depending on the application, as will be appreciated.

Perforations 12 are cut into label 2 along side region 10, using conventional die-cutting techniques. Perforations 12, represented in FIG. 3 by dashed lines, extend through at least second layer 6, and may extend through first layer 4 to release liner 14. Preferably release liner 14 remains uncut. It is not necessary to cut the perforations 12 deeper than first layer 6; however, a deeper cut allows the perforations to be cut with a wider tolerance, and therefore more quickly. The location and depth of perforations 12 can be different in other embodiments without departing from the scope of the invention.

Perforations 12 are designed to have certain tear resistance characteristics, as discussed below. The tear resistance of perforations 12 depends on the material from which second layer 6 is constructed and the design of the perforation slits 13, as is known in the art. If second layer 6 is constructed of polypropylene, then preferably perforations 12 have about ten slits per inch, and slits 13 have a "broken L" shape, as shown in FIG. 1.

Figure 7:
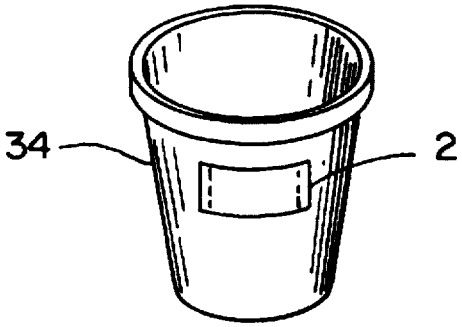
FIG. 7 is a perspective view of a labeled container after shrinking.

Label 2 also has a means for attaching first layer 4 to an object, such as release liner 14 or cup 34 (FIG. 7). One means of securing the first layer 4 to other objects is by coating the bottom 16 of first layer 4 with pressure-sensitive adhesive layer 18. Other adhesive systems can be used, as is known in the art. The adherence properties of the adhesive layer 18 and the pattern adhesive 8 in the side regions 10 are much greater than the tear resistance of the perforations 12. As a result, tab section 26 of the label 2 can be removed with very little effort, for example, by using a finger to lift or pull the tab section 26, while not removing first layer 4 from the object to which it is attached. Thus, a customer can peel tab section 26 of label 2 from the first layer 4, which is adhered to an object, by tearing along perforations 12 to expose the front 17 of first layer 4 and the back 19 of second layer 6. The customer can then read or see previously hidden information printed on the front 17 or the back 19. Any of the surfaces of first layer 4 or second layer 6 can include information, such as a design or writing, printed on it using conventional techniques and/or computer-generated variable imaging.

Release liner 14 includes a liner 20 with release coating layer 22. Release liner compositions and systems are known in the art. For example, in the preferred embodiment, liner 20 is paper, and release coating layer 22 is a silicon release composition.

Release liner 14, first layer 4, and second layer 6 are laminated using conventional production techniques, as is known in the art.

Figure 4:
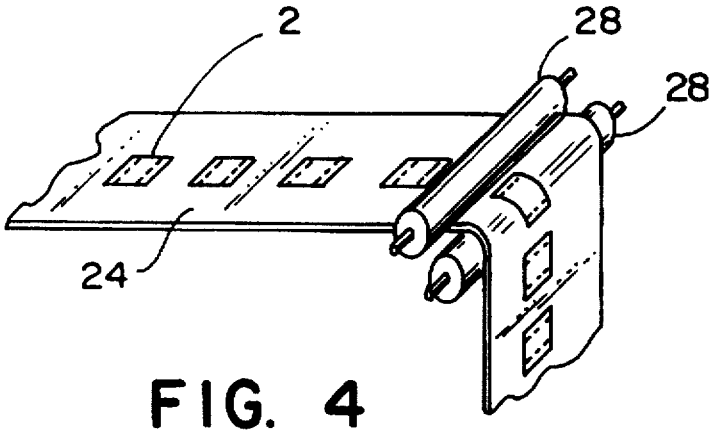
FIG. 4 is a perspective view of the labels of the present invention attached to a shrinkable web material moving through nip rollers.

In the process for forming containers labeled with multiple-layer labels, label 2 is applied to a shrinkable material or web 24 (FIG. 4). The shrinkable material 24 comprises, for example, an extruded polystyrene foam web suitable for use in the manufacture of the cups. Label 2 is attached to the material 24 by removing the release liner 14 to expose adhesive layer 18, and pressing the adhesive layer 18 against material 24. Preferably, adhesive layer 18 adheres to material 24 with sufficient strength so that during subsequent processing, the first layer 4 inhibits the shrinkage of the material 24 in the area to which first layer 4 is attached.

Continuing with FIG. 4, the web 24 feeds through nip rollers 28. If second layer 6 of label 2 were made of paper (contrary to the present invention), the perforations 12 have insufficient strength and flexibility to withstand the forces exerted during processing through the nip feed 28, and the perforations may break.

Figure 5:
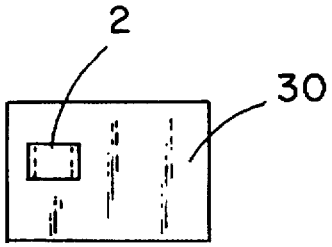
FIG. 5 is a perspective view of a cup blank die-cut from the labeled web material of FIG. 4.
Figure 6:
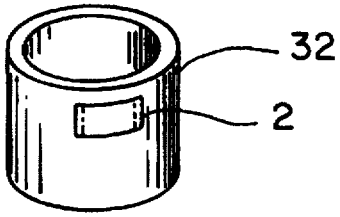
FIG. 6 is a perspective view of a labeled cup blank prior to shrinking.

Web 24 is cut into cup sections or blanks 30 (FIG. 5), for example, by using a die-cutter (not shown). Each cup section 30 is wrapped around a tapered, heated mandrel (not shown) to form frustoconical section 32 (FIG. 6). The heat from the tapered mandrel causes the shrinkable material from which frustoconical section 32 is made to shrink and conform to the shape of the mandrel, as is known in the art, and produce formed cup 34 (FIG. 7). During the shrinking process, the non-shrinking first layer 4 bonded to conical section 32 by adhesive layer 18 prevents the shrinkable material of conical section 32 from shrinking in the area to which first layer 4 is attached. Thus, the bond strength of adhesive layer 18 and the essentially non-shrinking attributes of first layer 4 prevent label 2 from deforming and distorting any writing or display printed on it.

Formed cup 34 post-cures for about two to three days after it has shrunk about the mandrel. During this post-cure period, the cup 34 shrinks an additional amount. The shrinking of the frustoconical section 32 and the post-cure shrinkage of formed cup 34 places a stress on the attached label 2. If second layer 6 is made of paper, the perforations 12 have insufficient strength to withstand this stress, and the perforations 12 often break.

To prevent the breakage of perforations 12 while keeping material costs acceptable, second layer 6 is preferably made of an inexpensive material that has both essentially extensible characteristics and a sufficiently high melt point so that when the shrinkable material 24 shrinks or forms around the heated mandrel, the perforations 12 do not break. The first layer 4 will insulate or shield the second layer 6 from some of the heat of the heated mandrel. Less preferred materials having extensible characteristics and sufficiently high melt points, such as polyester, presently are undesirably expensive for label applications. Preferably, second layer 6 is made of a polypropylene, as previously discussed.

The above descriptions are those of preferred embodiments of the invention. Various alterations and changes can be made without departing from the spirit and broader aspects of the invention as defined in the claims, which are to be interpreted in accordance with the principles of patent law, including the doctrine of equivalents.

The embodiments of the invention in which an exclusive property or privilege is claimed are defined as follows:

1. A multi-layer label for application to an object made of shrinkable material comprising:

a single sheet base layer of an essentially non-shrinking cellulose material;

a single sheet second layer of an essentially extensible material, said second layer including lines of weakening defining zones;

first adhesive means for attaching the base layer to the object;

second adhesive means in selected zones for securing the base layer directly to the second layer in laminated arrangement, the lines of weakening permitting at least one zone of the second layer to be removed from the second layer without removing the first layer from the object, such that said non-shrinking base layer supports said extensible second layer so that said second layer does not separate along the lines of weakening as the shrinkable material to which the label is affixed shrinks to form the object.

2. The label of claim 1 wherein the non-shrinking material comprises paper.

3. The label of claim 1 wherein the extensible material comprises a material selected from the group consisting of:

a polymer selected from the group consisting of polyethylene, polypropylene, polystyrene, polyester, and mixtures thereof;

a copolymer formed from monomers selected from the group consisting of ethylene, propylene, styrene, esters of terephthalic acid, glycols, and mixtures thereof; and mixtures thereof.

4. The label of claim 1 wherein the extensible material comprises polypropylene.

5. A multi-layer label for application to an object made of shrinkable material comprising:

a single sheet base layer of an essentially non-shrinking cellulose material, the base layer having front and back sides;

a single sheet second layer of an essentially extensible material, said second layer defining lines of perforations separating said second layer into a removal zone and two attachment zones on opposite sides of said removal zone;

means for adhesively attaching the back side of the base layer to an object;

an adhesive layer in said attachment zones between the base and second layers securing the front side of the base layer directly to the second layer in laminated arrangement, the lines of perforations enabling separation of said removal zone of the second layer from the second layer without removing the first layer from the object.

6. A labeled object including a shrinkable material and a multi-layer label adhered to the shrinkable material, wherein the improvement comprises the label comprising:

a single sheet base layer of an essentially non-shrinking cellulose material;

a single sheet second layer of an essentially extensible material, said second layer including lines of weakening defining zones; and adhesive means in selected zones securing the base layer directly to the second layer in laminated arrangement, the lines of weakening permitting at least one zone of the second layer to be removed from the second layer without removing the first layer from the shrinkable material, such that said non-shrinking base layer supports said extensible second layer so that said second layer does not separate along the lines of weakening as the shrinkable material to which the label is affixed shrinks to form the object.

7. The labeled object of claim 6 wherein the shrinkable material comprises polystyrene.

8. The labeled object of claim 6 wherein the object is formed by shrinking the shrinkable material around a heated mandrel.

9. The labeled object of claim 6 wherein the non-shrinking material comprises paper.

10. The labeled object of claim 6 wherein the extensible material comprises polypropylene.

11. The label of claim 1 wherein each of said base layer and said second layer comprise one and only one sheet.

12. The label of claim 5 wherein each of said base layer and said second layer comprise one and only one sheet.

13. The label of claim 6 wherein each of said base layer and said second layer comprise one and only one sheet.

* * * * *

UNITED STATES PATENT AND TRADEMARK OFFICE

CERTIFICATE OF CORRECTION

PATENT NO. : 5,792,536

DATED : August 11, 1998

INVENTOR(S) : Andrew Whipp

It is certified that error appears in the above-indentified patent and that said Letters Patent is hereby corrected as shown below:

Column 4, Line 63:

delete "for"

Signed and Sealed this

Nineteenth Day of January, 1999

*Attest:*

*Attesting Officer*

*Acting Commissioner of Patents and Trademarks*